US009920664B2

(12) United States Patent
Itoafa et al.

(10) Patent No.: US 9,920,664 B2
(45) Date of Patent: Mar. 20, 2018

(54) ACTUATOR FOR AN ELECTROHYDRAULIC GAS-EXCHANGE VALVE TRAIN OF A COMBUSTION ENGINE

(71) Applicant: Schaeffler Technologies AG & Co. KG, Herzogenaurach (DE)

(72) Inventors: Calin Petru Itoafa, Hochstadt (DE); Sandra Schafer, Bamberg (DE); Thomas Kremer, Furth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 53 days.

(21) Appl. No.: 15/113,957

(22) PCT Filed: Jan. 20, 2015

(86) PCT No.: PCT/DE2015/200006
§ 371 (c)(1),
(2) Date: Jul. 25, 2016

(87) PCT Pub. No.: WO2015/117603
PCT Pub. Date: Aug. 13, 2015

(65) Prior Publication Data

US 2016/0341080 A1 Nov. 24, 2016

(30) Foreign Application Priority Data

Feb. 4, 2014 (DE) ..... 10 2014 201 910

(51) Int. Cl.
*F01L 9/02* (2006.01)
*F01L 1/25* (2006.01)
*F01L 1/46* (2006.01)

(52) U.S. Cl.
CPC ..... *F01L 9/02* (2013.01); *F01L 1/25* (2013.01); *F01L 9/025* (2013.01); *F01L 1/46* (2013.01);
(Continued)

(58) Field of Classification Search
CPC ..... F01L 1/46; F01L 9/02; F01L 9/021; F01L 9/023
(Continued)

(56) References Cited

U.S. PATENT DOCUMENTS 4,826,180 A 5/1989 Deuring
5,511,460 A * 4/1996 Custer ..... F01L 13/065 123/321
(Continued)

FOREIGN PATENT DOCUMENTS

DE 3711436 7/1988
DE 102010048135 4/2012
EP 2009255 12/2008

*Primary Examiner* — Jorge Leon, Jr.
(74) *Attorney, Agent, or Firm* — Volpe and Koenig, P.C.

(57) ABSTRACT

An actuator for an electrohydraulic gas exchange valve train of a combustion engine is provided. The actuator has an actuator housing which can be mounted on the combustion engine with a borehole, a hydraulic piston, which is mounted therein such that it can carry out a reciprocating movement, for actuating the gas exchange valve and an axial stop which, when the actuator housing is in the unmounted state relative to the combustion engine, limits the piston stroke out of the borehole to a mounting stroke (T). This mounting stroke is smaller than a maximum operating stroke (L) with which the hydraulic piston actuates the gas exchange valve, the piston stroke being only temporarily limited to the mounting stroke by the axial stop and no longer being limited to the mounting stroke once the actuator is in operation.

10 Claims, 9 Drawing Sheets

(52) U.S. Cl.
CPC ..... *F01L 9/023* (2013.01); *F01L 2103/00* (2013.01); *F01L 2201/00* (2013.01)

(58) Field of Classification Search
USPC ..... 123/90.12
See application file for complete search history.

(56) References Cited

U.S. PATENT DOCUMENTS 6,273,057 B1 * 8/2001 Schwoerer ..... F01L 13/06 123/321
6,321,701 B1 * 11/2001 Vorih ..... F01L 9/021 123/321
6,338,320 B1 * 1/2002 De Ojeda ..... F01L 9/02 123/90.11
6,594,996 B2 * 7/2003 Yang ..... F01L 13/06 123/321
7,900,597 B2 * 3/2011 Meneely ..... F01L 13/065 123/323
2002/0053332 A1 * 5/2002 Chamberlin, III ... C10M 169/04 123/196 R
2002/0121251 A1 * 9/2002 Watson ..... F01L 9/02 123/90.12
2002/0184996 A1 * 12/2002 Lou ..... F01L 9/02 91/172
2002/0185091 A1 * 12/2002 Vorih ..... F01L 1/16 123/90.12
2004/0065283 A1 * 4/2004 Chang ..... F01L 1/26 123/90.12
2005/0034691 A1 2/2005 Chang
2013/0074790 A1 * 3/2013 Rabhi ..... F01L 9/04 123/90.11
2013/0174799 A1 7/2013 Itoafa et al.

* cited by examiner

ACTUATOR FOR AN ELECTROHYDRAULIC GAS-EXCHANGE VALVE TRAIN OF A COMBUSTION ENGINE

BACKGROUND

The invention relates to an actuator for an electrohydraulic gas-exchange valve train of a combustion engine. The actuator comprises an actuator housing that can be mounted on the combustion engine that includes a borehole, a hydraulic piston supported so that it can move in this borehole for actuating the gas-exchange valve, and an axial stop that restricts the piston stroke out of the borehole to a mounting stroke in the unmounted state of the actuator housing on the combustion engine.

For electrohydraulic valve trains, the variability of the control times and the maximum stroke on the gas-exchange valve is produced in a known way such that, between a cam of a camshaft and the gas-exchange valve, a so-called hydraulic linkage with a compression chamber is arranged whose volume can be regulated in a continuously variable way by an electromagnetic hydraulic valve in a pressure-relief chamber. Depending on the regulated volume of the hydraulic medium, the cam stroke specified by the camshaft is then converted completely, partially, or not at all into a stroke of the gas-exchange valve.

The present invention relates to the gas-exchange-valve-side part of the valve train actuator system whose movement corresponds to the stroke of the gas-exchange valve and is known, for example, from DE 10 2010 048 135 A1 according to the class. In the unmounted state of the actuator housing, the hydraulic piston does not sit on the gas-exchange valve and can move out of the borehole of the actuator housing under the effect of the force of gravity. This extension stroke is limited by an axial end stop to a mounting stroke in order to prevent the hydraulic piston from falling out of the borehole during the mounting of the actuator on the combustion engine.

The mounting stroke is not only to be dimensioned to the effect that the hydraulic piston does not fall out of the borehole before and during the mounting of the actuator housing, but also such that the end side of the extended hydraulic piston is always set with sufficient overlap on the end side of the gas-exchange-valve shaft, in order to prevent lateral placement or sliding of the hydraulic piston onto the circumference of the valve shaft. The risk of such incorrect mounting deforming the components increases if the gas-exchange valve is inclined—as is typical—toward the mounting direction of the actuator housing, and that is with increasing mounting stroke and increasing angle of inclination.

SUMMARY

The present invention is based on the objective of improving an actuator of the type named above structurally so that the security against incorrect assembly of the actuator housing on the combustion engine as explained above is increased.

The solution to this objective is given from one or more features of the invention. Accordingly, the mounting stroke should be less than a maximum operating stroke with which the hydraulic piston actuates the gas-exchange valve, wherein the limitation of the piston stroke to the mounting stroke is cancelled by the axial stop only temporarily and after the actuator has been put into operation. The stroke limitation to the relatively small mounting stroke can be cancelled either already during the actuator mounting by removing or displacing the axial stop or at the latest when the actuator has been put into operation such that the then operationally pressurized hydraulic piston is extended with an operating stroke exceeding the mounting stroke and in this way the position of the axial stop is displaced. The displacement can be realized relative to the borehole or to the hydraulic piston.

The operationally automatic displacement of the axial stop usually takes into account no longer existent accessibility of the actuator in the region of the hydraulic piston after placement of the actuator on the gas-exchange valve. For the case that this accessibility is nevertheless given, the temporary limitation of the piston stroke to the mounting stroke can be cancelled by a removable securing device. This can be, for example, a splint that holds the hydraulic piston and is removed during the actuator assembly.

The axial stop is formed in particular by an elastically deformable element that holds the hydraulic piston against the force of gravity by the spring force in the mounting stroke.

With respect to a new disassembly of the actuator for maintenance or repair of the combustion engine, it can be preferable that the actuator comprises another axial stop that limits in the mounted state of the actuator housing on the combustion engine the stroke of the hydraulic piston out of the borehole to a so-called disassembly stroke in order to prevent an uncontrolled staying of the hydraulic piston and optionally the mounting axial stop in the combustion engine even for the disassembly of the actuator and thus no-longer active axial stop for the mounting. The disassembly stroke is the same size but for acoustic reasons it is preferably greater than the maximum operating stroke of the gas-exchange valve.

BRIEF DESCRIPTION OF THE DRAWINGS

Additional features of the invention are given from the following description and from the drawings in which the invention in principle and sections or details that are essential for understanding the invention are shown for six embodiments of an actuator. If not mentioned otherwise, the same or functionally identical features or components are provided with identical reference numbers. Leading digits of three-digit reference numbers correspond to the numbering of the respective embodiment.

Shown are.

DETAILED DESCRIPTION OF THE PREFERRED EMBODIMENTS

Figure 1:
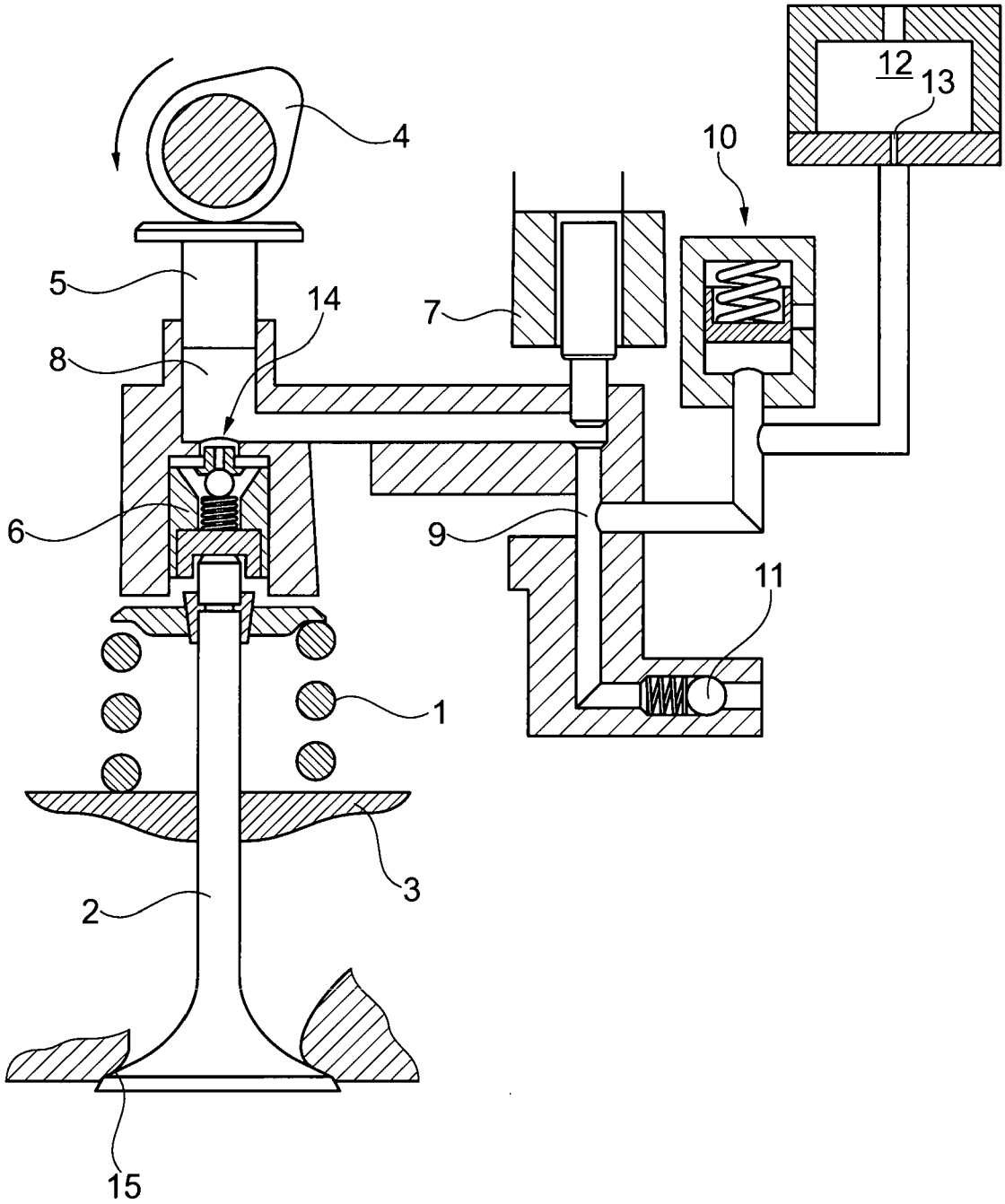
FIG. 1 a schematic view of a hydraulically variable valve train according to the state of the art, FIG. 2 a schematic view of an actuator according to the invention for the mounting in a cylinder head of a combustion engine, FIG. 3 the actuator according to FIG. 2 in the mounted state before the combustion engine is put into operation, FIG. 4 the actuator according to FIG. 3 after the combustion engine has been put into operation, FIG. 5 the first embodiment in longitudinal section, wherein the extension travel of the hydraulic piston is limited to the mounting stroke by a borehole-side inner sleeve and a piston-side sleeve, FIG. 6 the actuator housing according to FIG. 5 in a non-sectioned perspective view, FIG. 7 the first embodiment according to FIG. 5 in section, wherein the hydraulic piston is extended by the disassembly stroke, FIG. 8 the second embodiment in longitudinal section, wherein the extension travel of the hydraulic piston is limited by a piston-side polygonal ring and a borehole-side inner sleeve to the mounting stroke, FIG. 9 the second embodiment according to FIG. 8 in section, wherein the hydraulic piston is extended by the disassembly stroke, FIG. 10 the third embodiment in longitudinal section, wherein the extension travel of the hydraulic piston is limited to the mounting stroke by a borehole-side outer sleeve and a piston-side sleeve, FIG. 11 the borehole-side outer sleeve in perspective individual part view, FIG. 12 the third embodiment according to FIG. 10 in section, wherein the hydraulic piston is extended by the disassembly stroke, FIG. 13 the fourth embodiment in longitudinal section, wherein the extension travel of the hydraulic piston is limited to the mounting stroke by a borehole-side spring ring and a piston-side sleeve, FIG. 14 the fourth embodiment according to FIG. 13 in section, wherein the hydraulic piston is extended by the disassembly stroke, FIG. 15 the fifth embodiment in longitudinal section, wherein the extension travel of the hydraulic piston is limited to the mounting stroke by a borehole-side spring ring and a piston-side sleeve, FIG. 16 the fifth embodiment according to FIG. 15 in section, wherein the hydraulic piston is extended by the disassembly stroke, FIG. 17 the sixth embodiment in longitudinal section, wherein the extension travel of the hydraulic piston is limited to the mounting stroke by a borehole-side spring ring and a piston-side sleeve, FIG. 18 the sixth embodiment according to FIG. 17 in section, wherein the hydraulic piston is extended by the disassembly stroke.

FIG. 1 shows the principle structure of a known electro-hydraulic gas-exchange-valve train for the stroke-variable actuation of the gas-exchange valve 2 pressurized by a valve spring 1 in the closing direction in the cylinder head 3 of a combustion engine. Shown are the following components:

- a master piston 5 driven by the cam 4 of a camshaft,
- a slave piston 6 actuating the gas-exchange valve,
- an electromagnetic 2-2-way hydraulic valve 7,
- a high-pressure chamber 8 that is limited by the master piston and the slave piston and from which, when the hydraulic valve is open, hydraulic medium can flow out into a medium pressure chamber 9,
- a piston pressure accumulator 10 connected to the medium pressure chamber,
- a non-return valve 11 that opens in the direction of the medium pressure chamber and by which the medium pressure chamber is connected to the lubricant circuit of the combustion engine,
- and a low pressure chamber 12 that is used as a hydraulic medium reservoir and is connected to the medium pressure chamber by means of a throttle 13 and whose contents are available immediately during the starting process of the combustion engine.

The variability of the valve stroke is generated such that the high pressure chamber 8 acts between the master piston 5 and the slave piston 6 as a so-called hydraulic linkage, wherein the hydraulic volume displaced by the master piston—neglecting leakage—is split proportional to the stroke of the cam 4 as a function of the opening time and the opening period of the hydraulic valve 7 into a first partial volume pressuring the slave piston and into a second piston pressure accumulator 10 included in the medium pressure chamber 9 and into the partial volume flowing out of the low pressure chamber 12. Through the thus decoupled movement of the gas-exchange valve 2 from the movement of the cam, the stroke transfer of the master piston to the slave piston and consequently not only the control times, but also the stroke magnitudes of the gas-exchange valve are fully variably adjustable within the lifting of the cam. The closing ramp of the cam eliminated due to the decoupling is replaced by a hydraulic valve brake 14 that brakes the gas-exchange valve shortly before reaching the valve seat 15 to an acoustically and mechanically permissible closing speed.

For the embodiments of the invention explained below, the components arranged in the actuating sense between the cam 4 and the gas-exchange valve 2 should be assembled in an actuator housing to form one structural unit that is to be mounted as an actuator in a cylinder head of a combustion engine. As can be seen from FIGS. 2 to 4, the gas-exchange valve should be inclined here at an angle $\alpha$ to the mounting direction according to the direction of the arrow in FIG. 2 when placing the actuator 16 onto the cylinder head 3.

Figure 3:
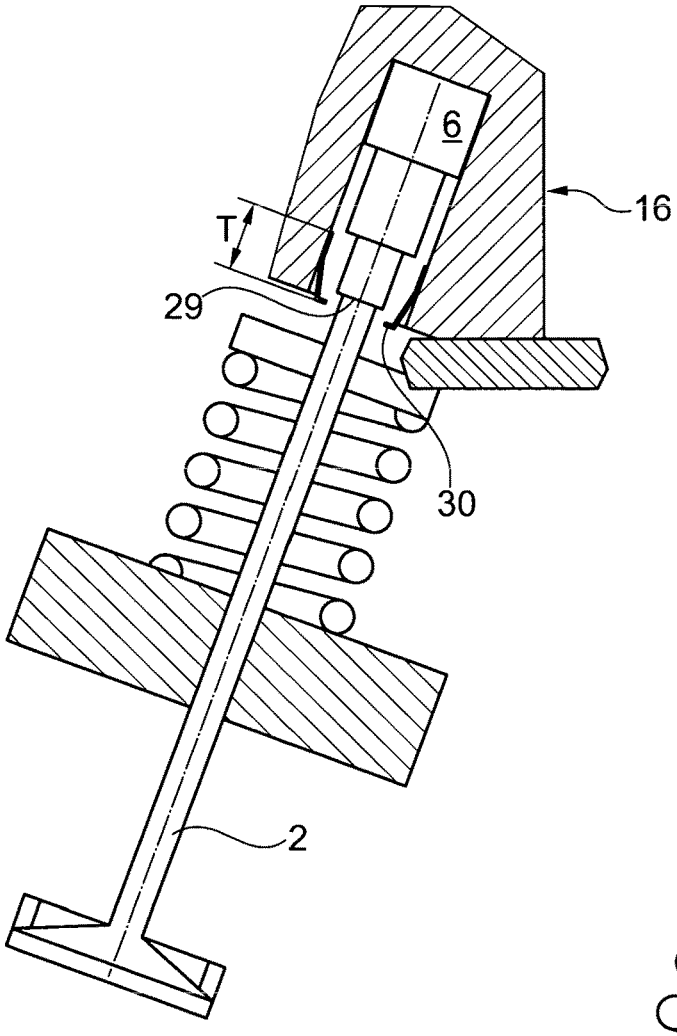

The actuator 16 comprises the actuator housing 17 with the slave piston 6 designated here generally and below as hydraulic piston that is displaced with a stroke-like motion in the borehole 18 of the actuator housing. Before and during the mounting process, the extension stroke of the hydraulic piston 6 based on the force of gravity out of the borehole is limited by means of an axial stop 19 to the dimension T designated as the mounting stroke. The reference for the dimension T is the position of the hydraulic piston retracted into the borehole at which the gas-exchange valve 2 is closed—see FIG. 3. The mounting stroke is dimensioned so that the end face 20 of the hydraulic piston extended therein is greatly eccentric, but is set due to sufficient overlap without incorrect mounting on the end side 21 of the gas-exchange-valve shaft (and no on its circumference). For further lowering of the actuator onto a flange surface 22 of the cylinder head 3, the hydraulic piston must deflect the gas-exchange valve, wherein it travels into the borehole and is simultaneously oriented concentrically to the gas-exchange valve. FIG. 3 shows this completely mounted state of the actuator before the combustion engine is put into operation.

Figure 2:
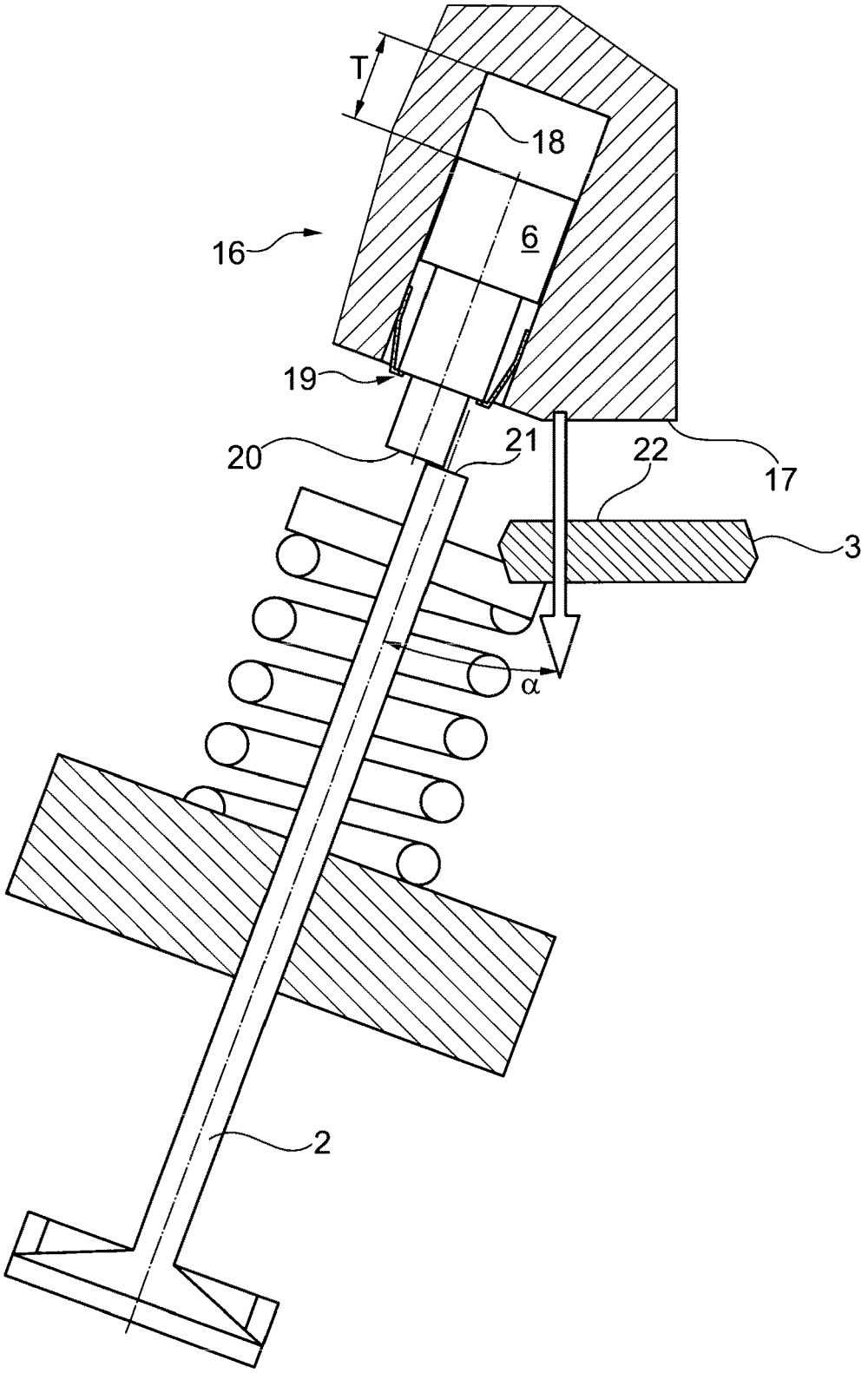
Figure 4:
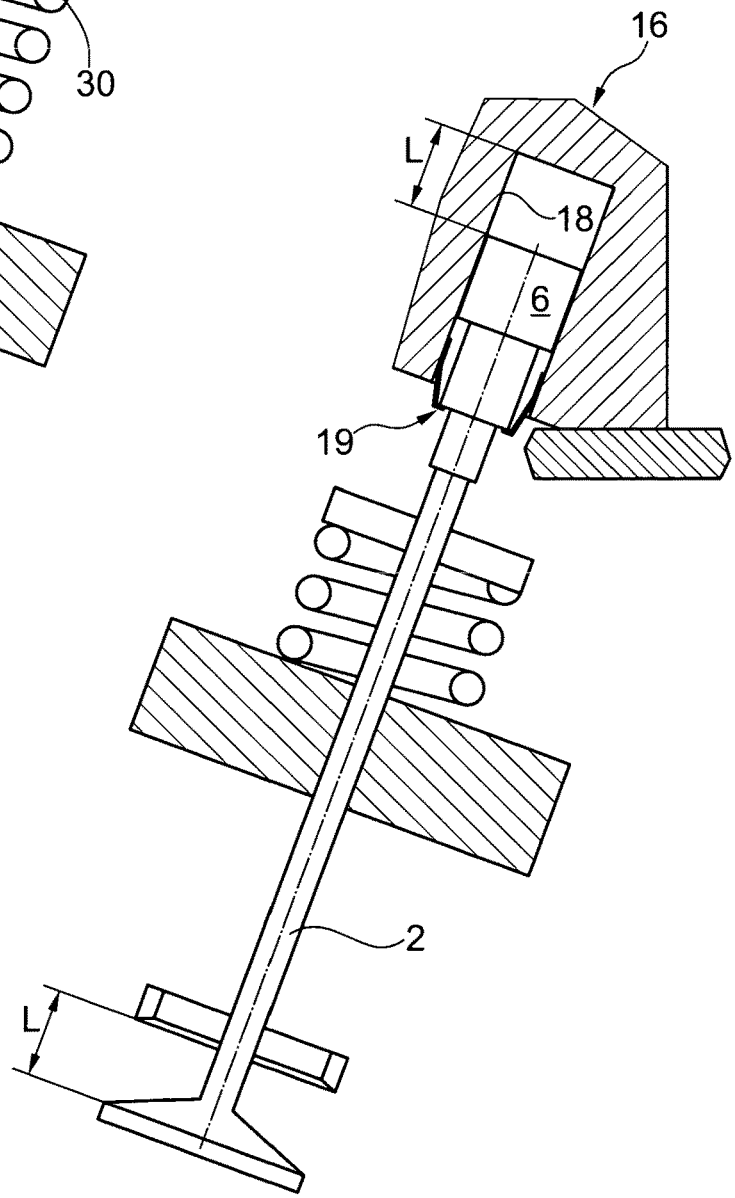

With the help of FIG. 2, it can be easy imaged that with increasing inclination angle $\alpha$, the end-side overlap of the hydraulic piston 6 and valve shaft 2 and consequently the dimension T of the mounting stroke permissible for error-free actuator mounting become smaller. FIG. 4 shows the case that the maximum operating stroke of the gas-exchange valve designated with L is greater than the mounting stroke T. So that the hydraulic piston can extend and retract without contact for actuating the gas-exchange valve, the mounting-required limitation to the mounting stroke may be cancelled only temporarily and must be cancelled when the combustion engine is operating. This takes place according to the invention in that the axial stop 19 is displaced at least by the difference dimension between L and T. The displacement is clear from the comparative view of the positions of the axial stop in FIGS. 3 and 4 before and after the combustion engine/actuator 16 is put into operation and is realized by the hydraulic piston itself, which here shifts the part of the axial stop fixed in the borehole 18 relative to the borehole in the outward direction with operational pressurization. In the not shown reverse kinematics, it is analogously possible to fix the displaceable part of the axial stop on the hydraulic piston and to move the hydraulic piston relative to this piston-side stop part in the outward direction.

Figure 5:
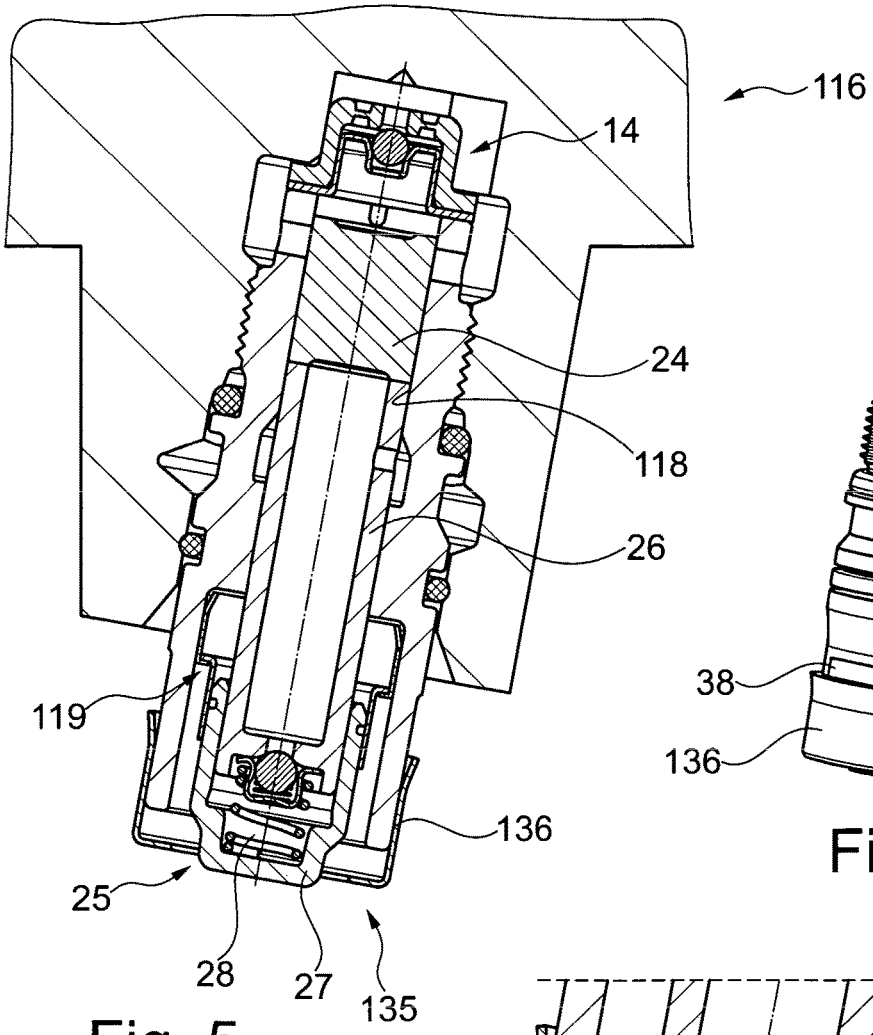
Figure 6:
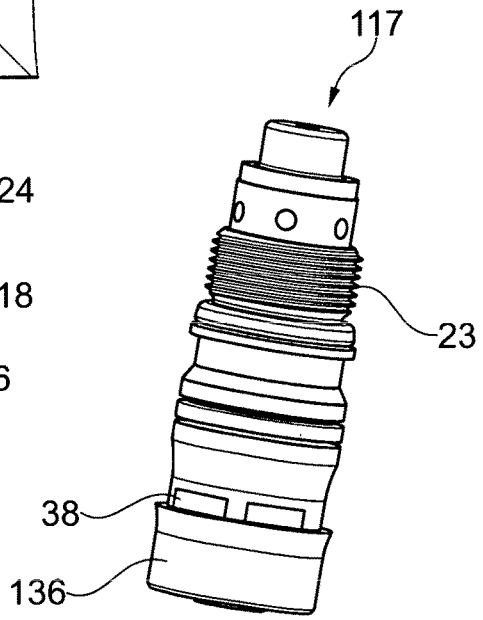
Figure 7:
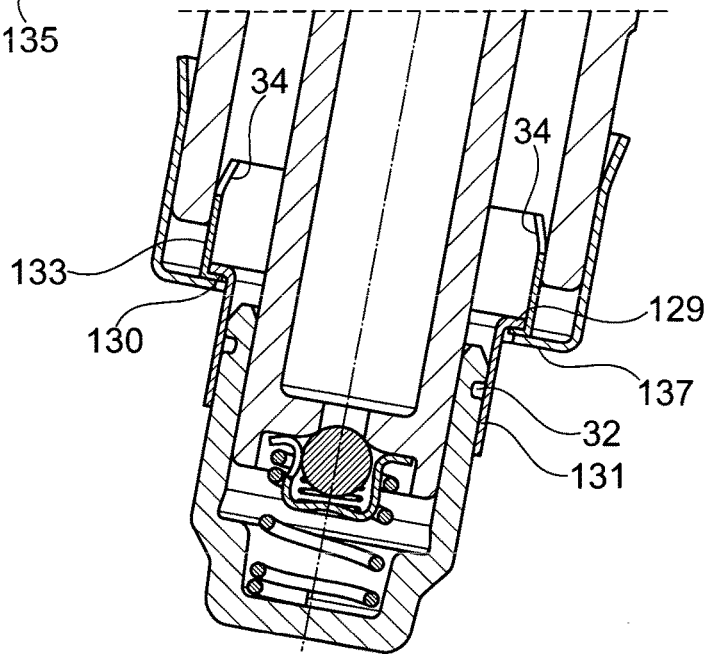

FIGS. 5 to 7 show the first structural design of the invention. The actuator 116 comprises, in a typical construction, a hollow-cylindrical actuator housing 117 that is mounted by a threaded connection 23 in a receptacle of the actuator and in this way holds the valve brake 14 inserted on the receptacle base on the end side. The hydraulic piston 6 supported so that it can move with a stroke movement underneath the valve brake in the borehole 118 of the actuator housing is assembled in series connection from a solid pressure piston 24 and a hydraulic valve play compensation element 25 with a hollow cylindrical piston shaft 26 and a compensation housing 27. This actuates the gas-exchange valve 2 and encloses the valve-side end section of the piston shaft while forming a height-variable pressure chamber 28 as valve play compensation.

In general, for all embodiments explained below for the axial stop 19 limiting the piston stroke to the (relatively small) mounting stroke, the following applies: This comprises a piston-side part 29 that is formed by a radially outward extending projection from the outer circumference of the compensation housing 27. As shown in principle in FIGS. 2 to 4, the borehole-side part 30 of the axial stop 19 can be displaced relative to the borehole 18, in order to cancel the limiting of the piston stroke to the mounting stroke T, and formed by a projection extending radially inward at the front or into the inner circumference of the borehole, wherein the two projections 29 and 30 overlap radially. In addition, it is always provided that the canceling of the stroke limiting to the mounting stroke is reversible. This means that the original stop positioning after the disassembly of the actuator 16 for the purpose of maintaining or repairing the combustion engine can be re-established by pushing the displaced stop part back—in the embodiments, this is the borehole-side stop part 30.

In the first embodiment according to FIGS. 5 to 7, the piston-side projection 129 is now formed by a radially outward extending collar of a sleeve 131 mounted on the compensation housing 27. The sleeve is mounted by means of an interference fit in an outer circumferential groove 32 of the compensation housing. The borehole-side projection 130 is generally formed on a ring 33 and here by a radially inward extending collar of an inner sleeve 133. The inner sleeve is held by a clamped section on the inner circumference of the borehole 118 stepped in diameter in the area of the valve play compensation element and indeed initially according to FIG. 5 in the vicinity of the diameter step, in order to limit the extension stroke of the hydraulic piston 6 to the mounting stroke. The clamping characteristics of the inner sleeve can be improved by elasticity-increasing slots 34 on its circumference.

The piston-side projection 129 of the hydraulic piston 6 extending after assembly with the application of an operating pressure carries along the thus radially overlapping, borehole-side projection 130, so that the limiting of the piston stroke to the mounting stroke is canceled. The axial clamping position of the inner sleeve 133 moved into the borehole 118 is displaced as a function of the maximum gas-exchange valve stroke, but maximally only so far until the inner sleeve contacts another axial limit stop. This additional axial limit stop designated generally with 35 limits the piston stroke out of the borehole 18 in the assembled state of the actuator 16 on the combustion engine to the disassembly stroke mentioned above, in order to also prevent for the disassembly of the actuator from the cylinder head 3 of the combustion engine a falling out of the axial limit stop 19 and the hydraulic piston 6 out of the actuator housing 17. The disassembly stroke R is drawn as an example in FIG. 8 and is at least as large for preventing operational contact noises in the axial limit stop but greater than the maximum stroke of the gas-exchange valve 2.

The additional axial limit stop 135 is formed by a cap 136 that is mounted around the borehole 118 on the outer circumference of the actuator housing 117. The cap has a projection in the form of a collar 137 that extends according to FIG. 7 radially inward into the inner circumference of the borehole and radially overlaps the borehole-side projection 130 of the inner sleeve 133. In this way, a disassembly-caused falling out of the two sleeves 131, 133, the hydraulic valve play compensation element 25, and the pressure piston 24 out of the borehole is prevented.

The tool engagement required for screwing the actuator housing 117 into its receptacle is formed as an outer hexagon head 38 on the actuator housing and can be seen in FIG. 6 underneath the cap 136 already mounted in this view.

Figure 8:
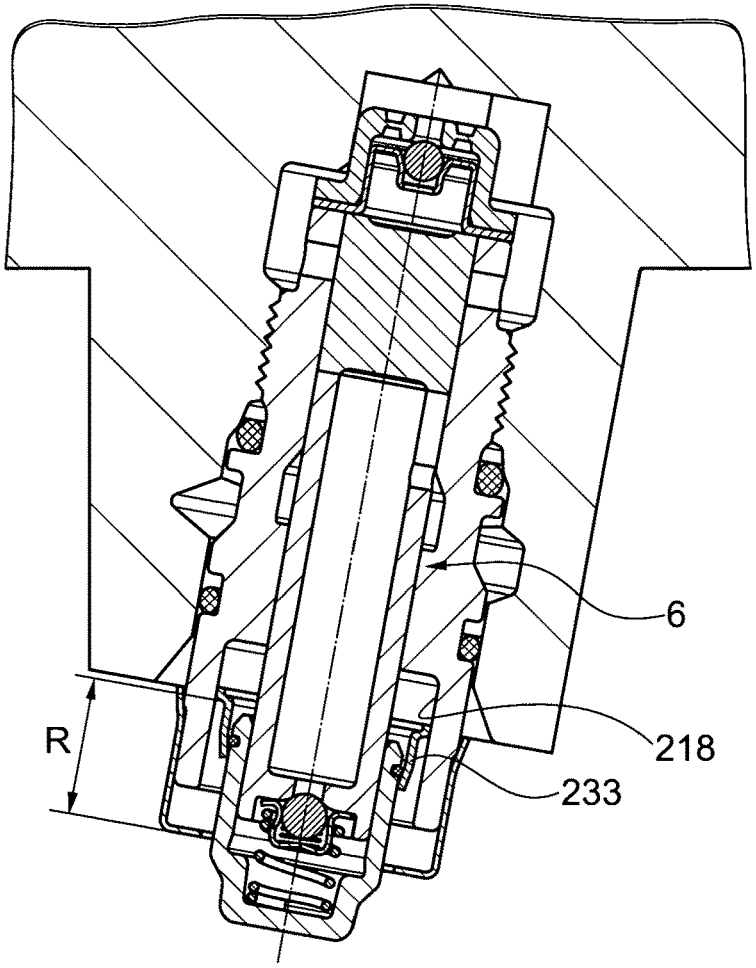
Figure 9:
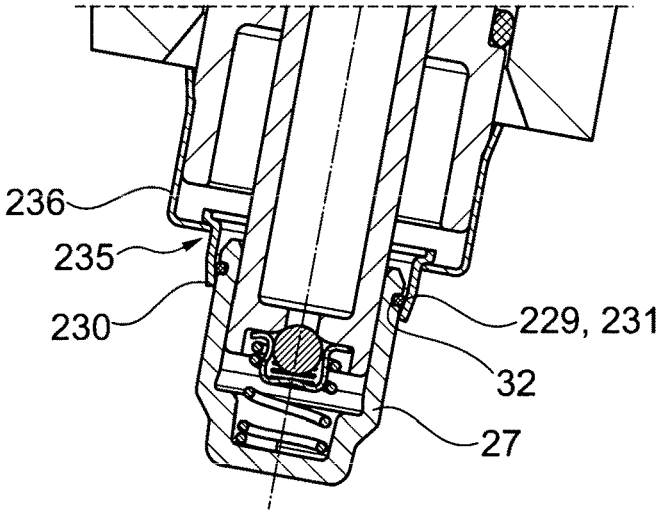

In the second embodiment shown in FIGS. 8 and 9, the piston-side projection 229 is formed by an elastic, polygonal wire ring 231 that is held in the outer circumferential groove 32 of the compensation housing 27 and projects radially due to the polygonal shape in some sections relative to the outer circumferential groove. As in the first embodiment, the borehole-side projection 230 is formed by a ring 233 clamped on the inner circumference of the borehole 218 in the form of an inner sleeve that engages below the wire ring. When an operating pressure is applied to the hydraulic piston 6, the inner sleeve 233 is shifted by the wire ring until it completely leaves the borehole and contacts the cap 236 forming the additional axial limit stop 235.

Figure 10:
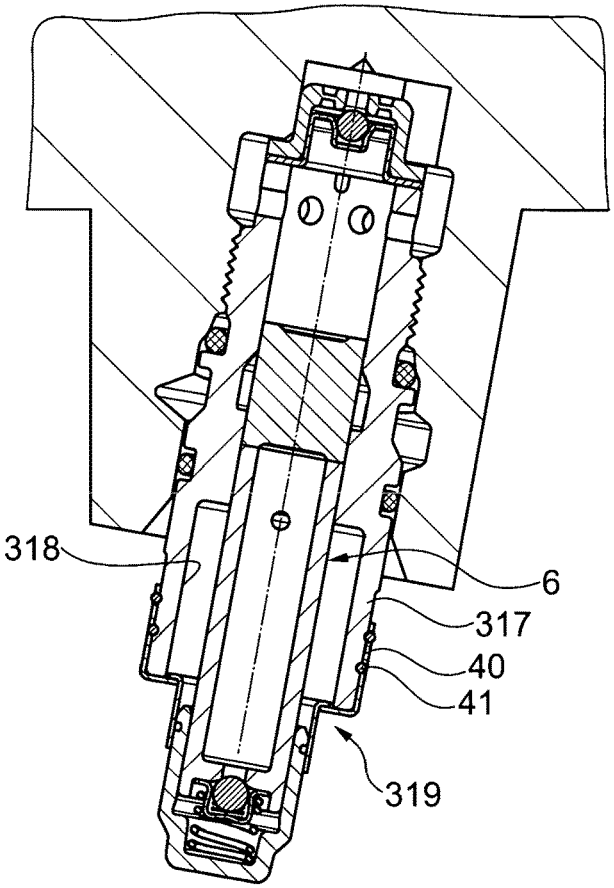
Figure 11:
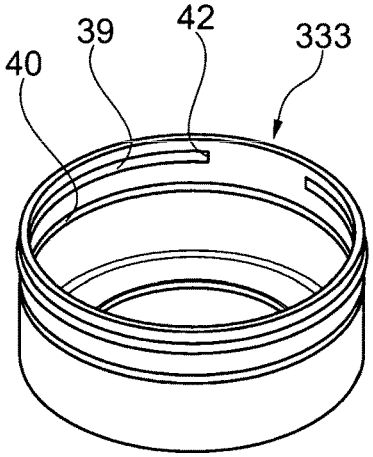
Figure 12:
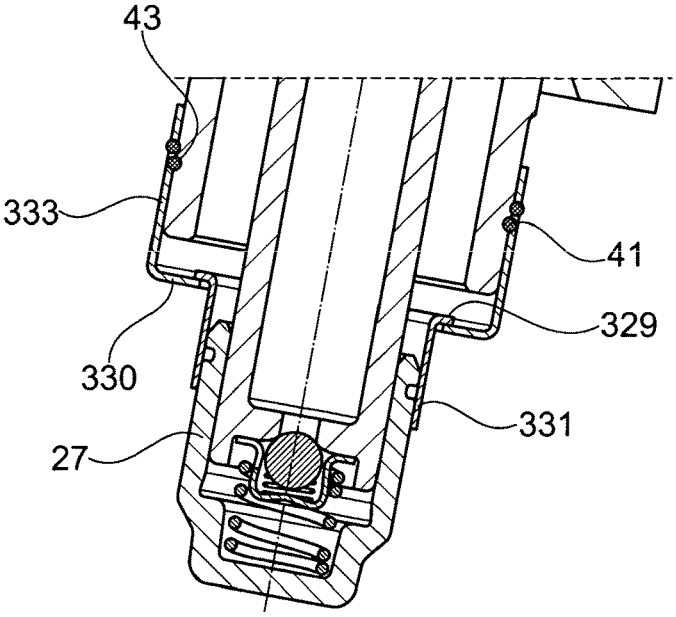

The axial limit stop 319 of the third embodiment according to FIGS. 10 to 12 comprises, as in the first embodiment, a sleeve 331 mounted on the compensation housing 27 with collar as piston-side projection 329. The borehole-side projection 330 is formed, in contrast, by the collar of a ring 333 in the form of an outer sleeve that is held by a clamped section on the outer circumference of the actuator housing 317. The collar 330 extends from the outside radially inward into the inner circumference of the borehole 318.

The outer sleeve 333 shown in FIG. 11 as an individual part latches in two axial positions on the actuator housing 317 and is provided for this purpose on the inner circumference with an upper bead 39 and a lower bead 40 that are supported according to the stroke position of the hydraulic piston 6 on an outer circumferential bead 41 of the actuator housing. Here, the piston stroke out of the borehole 318 is limited to the mounting stroke when, according to FIG. 10, the lower inner bead 40 is supported on the outer bead 41. The piston stroke is limited to the disassembly stroke when, in the other axial limit position according to FIG. 12, the upper inner bead 39 is supported on the outer bead. The upper inner bead and the outer bead are each formed by a spring ring, wherein the spring ring 39 is held in a slot 42 of the outer sleeve and the spring ring 41 is held in an outer circumferential groove 43 of the actuator housing. The lower inner bead is formed by a circumferential molding in the outer sleeve.

Figure 13:
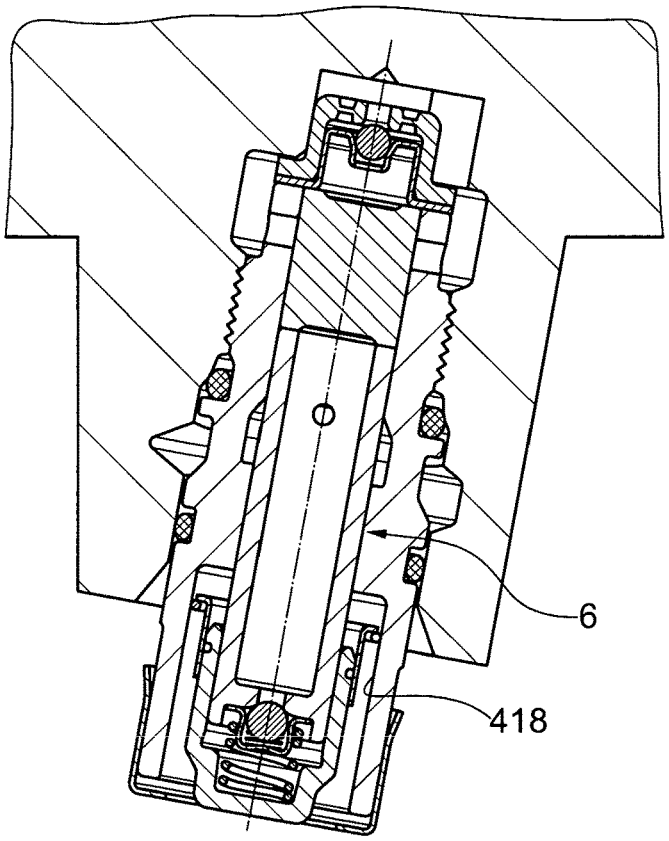
Figure 14:
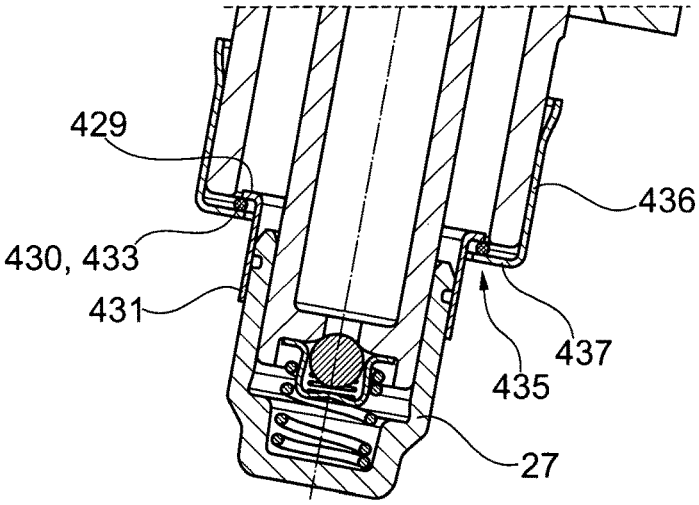

The fourth embodiment of the invention is illustrated in FIGS. 13 and 14. As in the first and third embodiment, it comprises a sleeve 431 mounted on the compensation housing 27 with collar as a piston-side projection 429. The borehole-side projection 430 is formed by a ring 433 in the form of an open wire ring that is held in a clamping way by its own spring force on the inner circumference of the borehole 418 and engages under the collar 429 of the sleeve. As an analogy to the first and second embodiment, the wire ring 433 is shifted by the sleeve when the hydraulic piston 6 moves out due to operational pressure application. The wire ring can leave the borehole completely and contacts, in the position of the disassembly stroke, on the collar 437 of the cap 436 as an additional axial limit stop 435.

Figure 15:
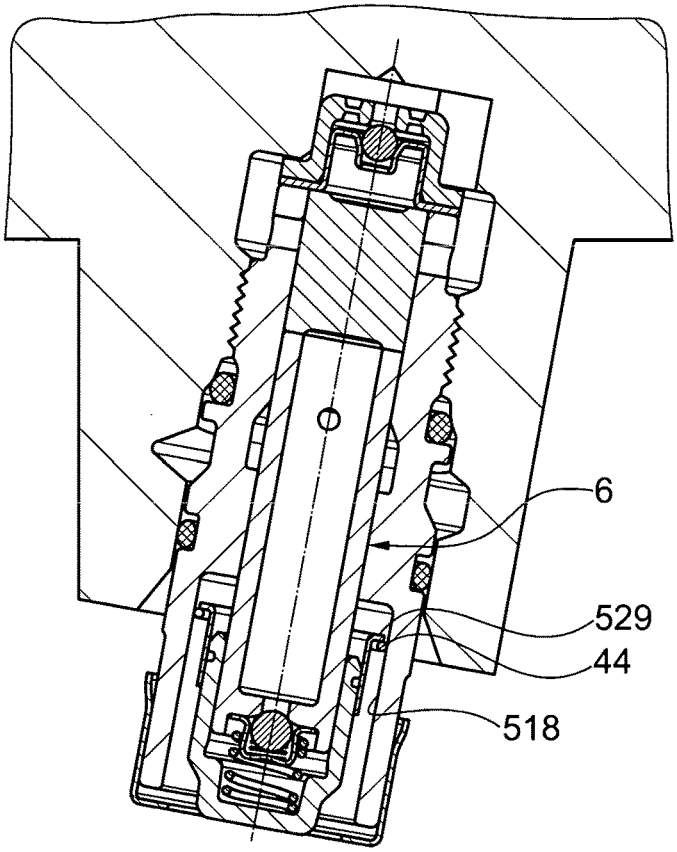
Figure 16:
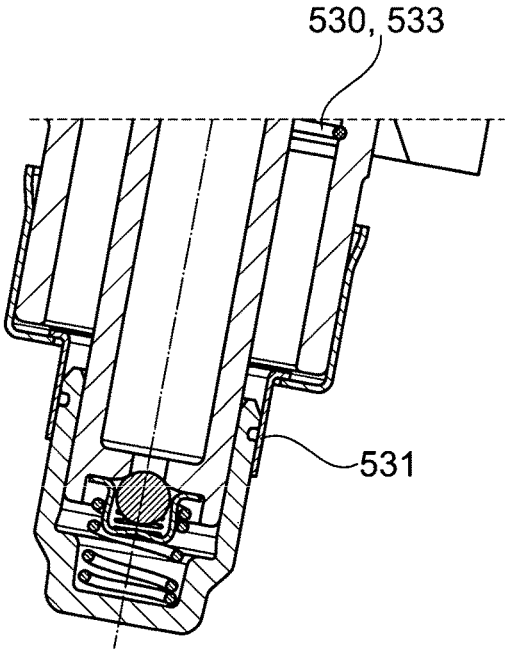

The fifth embodiment shown in FIGS. 15 and 16 differs from the fourth embodiment such that the elastic wire ring 533 is held in an inner circumferential groove 44 of the borehole 518 and has a polygonal construction as a borehole-side projection 530. Thus, the wire ring can deflect radially when operating pressure is applied to the hydraulic piston 6 and is displaced toward the collar 529 of the sleeve 531 into the inner circumferential groove when the radial overlap is canceled, in order to cancel the limiting of the piston stroke to the mounting stroke.

Figure 17:
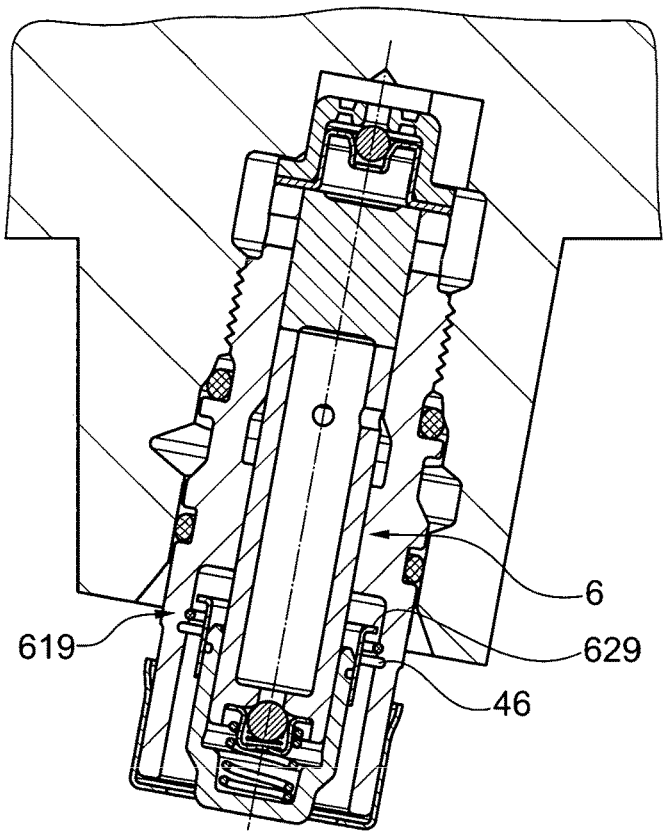
Figure 18:
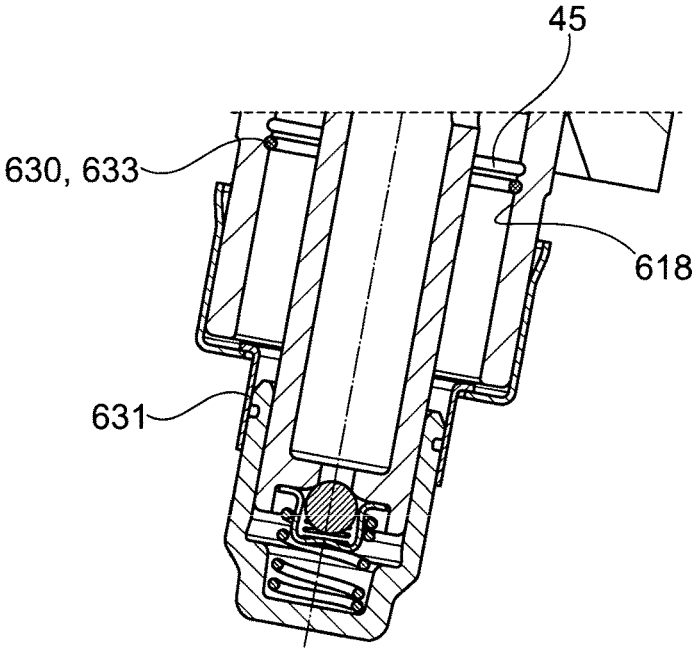

Deviating from the fifth embodiment, the axial limit stop 619 is displaced both in the axial and also radial directions in the sixth embodiment according to FIGS. 17 and 18. The borehole 618 is provided with two axial, spaced-apart inner circumferential grooves 45 and 46 in which the borehole-side projection 630 can spread out in the form of the wire ring 633. The diameter of the upper inner circumferential groove 45 must be dimensioned so that the wire ring spread apart in the mounting stroke of the hydraulic piston 6 and the collar 629 of the sleeve 631 overlap in the radial direction as contact parts. When operating pressure is applied on the axially displaced hydraulic piston, initially the wire ring must latch out of the upper inner circumferential groove and follow the collar up to the lower inner circumferential groove 46 in which the wire ring then spreads out. The lower inner circumferential groove has a larger diameter than the upper inner circumferential groove and must be dimensioned such that the radial overlap between the spread-apart wire ring and the collar is canceled.

LIST OF REFERENCE NUMBERS

1 Valve spring
2 Gas-exchange valve
3 Cylinder head
4 Cam
5 Master piston
6 Slave piston/hydraulic piston
7 Hydraulic valve
8 High-pressure chamber
9 Medium-pressure chamber
10 Piston pressure accumulator
11 Non-return valve
12 Low-pressure chamber
13 Throttle
14 Valve brake
15 Valve seat
16 Actuator
17 Actuator housing
18 Borehole
19 Axial stop
20 End side of the hydraulic piston
21 End side of the gas-exchange-valve shaft
22 Flange surface of the cylinder head
23 Threaded connection
24 Pressure piston
25 Valve play compensation element
26 Piston shaft
27 Compensation housing
28 Pressure chamber
29 Piston-side stop part/projection (collar)
30 Bore-side stop part/projection (collar)
31 Sleeve/wire ring
32 Outer circumferential groove of the compensation housing
33 Ring (inner sleeve, wire ring, outer sleeve)
34 Slot
35 Additional axial stop
36 Cap
37 Collar
38 Hexagon head
39 Upper bead/spring ring
40 Lower bead
41 Outer circumferential bead/spring ring
42 Slot
43 Outer circumferential groove
44 Inner circumferential groove
45 Upper inner circumferential groove
46 Lower inner circumferential groove

The invention claimed is:

1. An actuator for an electrohydraulic gas-exchange valve train of a combustion engine, comprising an actuator housing that is mountable on the combustion engine with a borehole, a hydraulic piston movably supported for a piston stroke motion in the borehole for actuating the gas-exchange valve, and an axial stop that limits the piston stroke motion out of the borehole to a mounting stroke (T) in an unmounted state of the actuator housing on the combustion engine, the mounting stroke (T) is less than a maximum operating stroke (L) with which the hydraulic piston actuates the gas-exchange valve, and the limiting of the piston stroke motion to the mounting stroke (T) by the axial stop is cancelled only temporarily and after the actuator has been put into operation.

2. The actuator according to claim 1, wherein the hydraulic piston displaces a position of the axial stop relative to the borehole or to the hydraulic piston due to operating pressurization such that the limitation of the piston stroke to the mounting stroke (T) is cancelled.

3. The actuator according to claim 2, wherein the hydraulic piston comprises a hydraulic valve play compensation element with a piston shaft and a compensation housing that surrounds a gas-exchange-valve-side end section of the piston shaft and actuates the gas-exchange valve, a piston-side part of the displaceable axial stop is formed by a piston-side projection extending radially outwards from an outer circumference of the compensation housing and a borehole-side part of the displaceable axial stop is formed by a borehole-side projection extending radially inward at a front or in an inner circumference of the borehole and the piston-side and borehole-side projections overlap radially.

4. The actuator according to claim 3, wherein the piston-side projection is formed by a wire ring held in an outer circumference groove of the compensation housing.

5. The actuator according to claim 3, wherein the limitation of the piston stroke to the mounting stroke (T) is cancelled by displacing the borehole-side projection relative to the borehole.

6. The actuator according to claim 5, wherein the borehole-side projection is formed by a ring that is held on the inner circumference of the borehole by a clamping part and consequently displaces the piston-side projection of the operationally pressurized hydraulic piston in an axial direction.

7. The actuator according to claim 6, wherein the ring is constructed as a wire ring that consequently displaces initially the piston-side projection of the operationally pressurized hydraulic piston in the axial direction and then spreads out while cancelling a radial overlap with the piston-side projection in an inner circumferential groove of the borehole.

8. The actuator according to claim 5, wherein the borehole-side projection is formed by a ring that is held on an outer circumference of the actuator housing by a clamping part and consequently displaces the piston-side projection of the operationally pressurized hydraulic piston in an axial direction.

9. The actuator according to claim 5, wherein the actuator comprises another axial stop that limits the piston stroke out of the borehole to a disassembly stroke (R) in a mounted state of the actuator housing on the combustion engine, and said disassembly stroke is equal to or greater than the maximum operating stroke (L).

10. The actuator according to claim 9, wherein a sleeve is held on an outer circumference of the compensation housing that includes a ring for connection to the actuator housing, the ring latches into one of a first axial position and a second axial position on an outer circumference of the actuator housing, and the ring limits the piston stroke out of the borehole in the first axial position to the mounting stroke (T) and in the second axial position to the disassembly stroke (R).

* * * * *